US006659456B2

(12) United States Patent
Hieb

(10) Patent No.: US 6,659,456 B2
(45) Date of Patent: Dec. 9, 2003

(54) SHEET TRANSPORT DRUM

(75) Inventor: Christian Hieb, Neuhofen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 96 days.

(21) Appl. No.: 10/053,971

(22) Filed: Jan. 22, 2002

(65) Prior Publication Data

US 2002/0096825 A1 Jul. 25, 2002

(30) Foreign Application Priority Data

Jan. 19, 2001 (DE) ..... 101 02 226

(51) Int. Cl.[7] ..... B65H 5/02
(52) U.S. Cl. ..... 271/275; 101/409
(58) Field of Search ..... 271/275; 101/409; 198/867.1; B65H 5/02

(56) References Cited

U.S. PATENT DOCUMENTS 4,204,471 A * 5/1980 Becker ..... 101/410
4,858,910 A * 8/1989 Rebel et al. ..... 271/204
5,172,634 A * 12/1992 Iwamoto ..... 101/410
5,685,226 A * 11/1997 Fuller ..... 101/415.1
6,166,160 A * 12/2000 Ngoc ..... 526/329.3
6,438,352 B1 * 8/2002 Landa et al. ..... 399/401

FOREIGN PATENT DOCUMENTS

| | | |
|---|---|---|
| DE | 2632243 | 1/1978 |
| DE | 4221046 C2 | 1/1994 |
| EP | 0 875 376 A1 | 11/1998 |

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Ralph E. Locher

(57) ABSTRACT

Provided in a sheet-fed printing machine is a sheet transport drum, including a first comb segment and a second comb segment, the second comb segment being mounted so as to be rotatable relative to the first comb segment for providing an adjustment to a format length corresponding with that of a printing-material sheet, the comb segments being formed of prongs having interspaces therebetween, and at least one covering provided for covering the interspaces between the prongs.

11 Claims, 3 Drawing Sheets

SHEET TRANSPORT DRUM

BACKGROUND OF THE INVENTION

FIELD OF THE INVENTION

The invention relates to a sheet transport drum in a sheet printing machine, the transport drum including a first comb segment and a second comb segment, of which the latter is mounted so as to be rotatable relative to the first comb segment for adjusting to a format length corresponding with a printing-material sheet.

Heretofore known sheet transport drums of the foregoing general type are subject to the following problem: depending upon how far the second comb segment is rotated relative to the first comb segment, interspaces of greater or lesser size gape open between prongs of the comb segments, and air flows outwardly through the interspaces from the interior of the sheet transport drum under the action of centrifugal force. The air flowing out of the sheet transport drum in an undesired manner causes the printing-material sheet overlapping the interspaces to be lifted off in an uncontrolled manner as the sheet is transferred from the sheet transport drum to a further sheet transport drum. Until the present, this unavoidable disruption of the sheet transport resulting from the construction of the heretofore known sheet transport drums has stood as an obstacle to a further increase in the rotational speed of the sheet transport drum, i.e., the speed of the sheet-fed printing machine.

SUMMARY OF THE INVENTION

It is accordingly an object of the invention to provide a sheet transport drum with comb segments which prevent the printing-material sheet from being lifted off the drum in an uncontrolled manner even at very high machine speeds.

With the foregoing and other objects in view, there is provided, in accordance with one aspect of the invention, in a sheet-fed printing machine, a sheet transport drum, comprising a first comb segment and a second comb segment, the second comb segment being mounted so as to be rotatable relative to the first comb segment for providing an adjustment to a format length corresponding with that of a printing-material sheet, the comb segments being formed of prongs having interspaces therebetween, and at least one covering provided for covering the interspaces between the prongs.

In accordance with another feature of the invention, the at least one covering engages, at the inside thereof, at least one of the comb segments.

In accordance with a further feature of the invention, the at least one covering is constructed so as to be actuatable pneumatically.

In accordance with an added feature of the invention, the at least one covering is inflatable.

In accordance with an additional feature of the invention, the at least one covering is selected from the group consisting of a flexible tube, a bellows and a balloon.

In accordance with yet another feature of the invention, the at least one covering engages at the outside thereof with at least one of the comb segments.

In accordance with yet a further feature of the invention, the at least one covering is a foil.

In accordance with yet an added feature of the invention, the at least one covering is partially wound up.

In accordance with another aspect of the invention, there is provided a sheet-fed printing machine including at least one sheet transport drum, comprising a first comb segment and a second comb segment, the second comb segment being mounted so as to be rotatable relative to the first comb segment for providing an adjustment to a format length corresponding to that of a printing-material sheet, the comb segments being formed of prongs having interspaces therebetween, and at least one covering provided for covering the interspaces between the prongs.

In accordance with a further feature of the invention, the sheet-fed printing machine includes a reversing device of which the sheet transport drum is a constituent part.

In accordance with a concomitant feature of the invention, the sheet transport drum is constructed as a storage drum, and the reversing device includes a further sheet transport drum constructed as a reversing drum.

Thus, the invention calls for interspaces between prongs of the comb segments to be covered by at least one covering.

Of course, this covering is not identical with the printing-material sheet.

The printing-material sheet is guided on the sheet transport drum according to the invention just as reliably as on a sheet transport drum having a continuous circumferential surface or as on an impression cylinder, even at very high machine speeds of, for example, 15,000 or more printed sheets per hour.

It is possible, for example, to provide a first covering for covering interspaces between the prongs of the first comb segment, and a second covering for covering interspaces between the prongs of the second comb segment. The at least one covering may be constructed so that it can be pneumatically actuated and/or wound up and unwound. It is also possible for the covering, at the outside or the inside thereof, to engage with at least one of the comb segments.

Other features which are considered as characteristic for the invention are set forth in the appended claims.

Although the invention is illustrated and described herein as embodied in a sheet transport drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
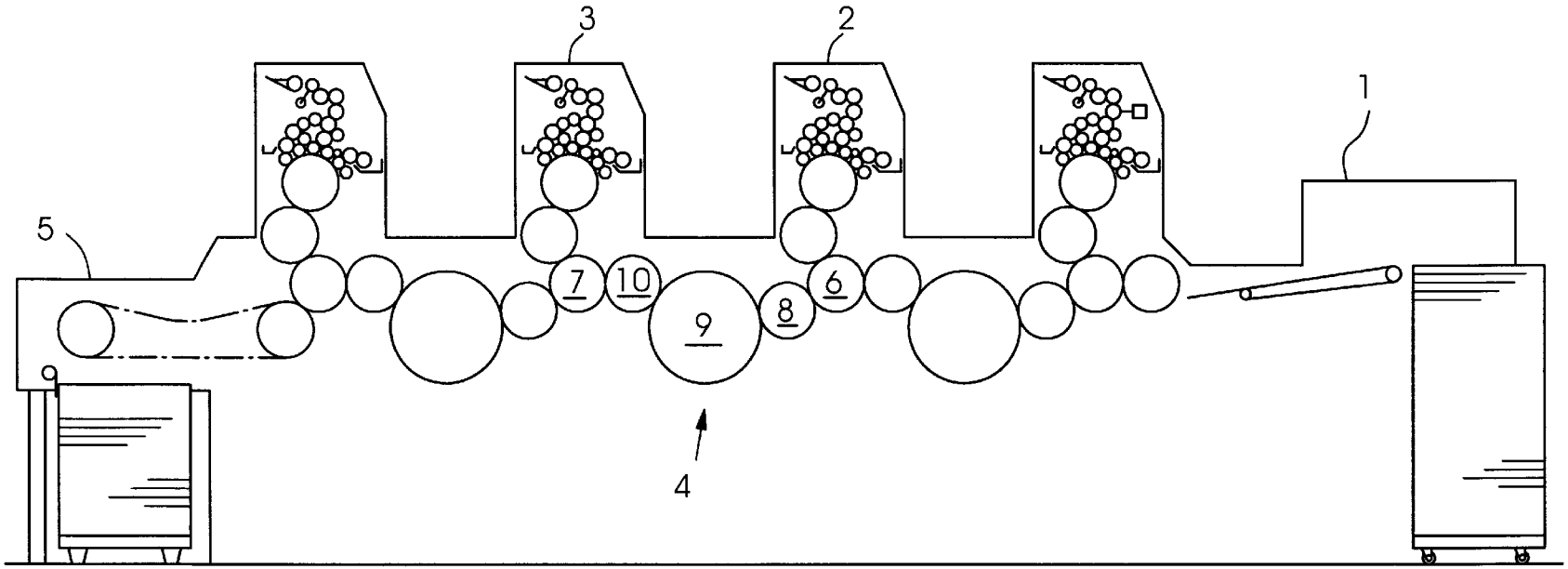
FIG. 1 is a diagrammatic side elevational view of a sheet-fed rotary printing machine having a reversing or turning device.

Referring now to the drawings, and first particularly to FIG. 1 thereof, there is shown therein a sheet-fed rotary printing machine constructed as a unit with a sheet feeder 1, printing units 2 and 3 for printing on printing-material sheets by the offset printing method, a reversing or turning device 4 disposed between the printing units 2 and 3, and a sheet delivery 5.

Each of the printing units 2 and 3 includes a printing-form cylinder, a blanket cylinder and an impression cylinder 6, 7. The reversing or turning device 4 has three sheet transport drums 8, 9 and 10, which are arranged between the impression cylinders 6 and 7. The sheet transport drum 9 functions as a so-called storage drum and, by a gripper system thereof, firmly holds the printing-material sheet at the leading edge thereof. The sheet transport drum 10 functions as a so-called reversing or turning drum and, by the gripper system thereof, grips a trailing edge of the printing-material sheet in order to reverse or turn the latter and draw it off the sheet transport drum 9.

Figure 2:
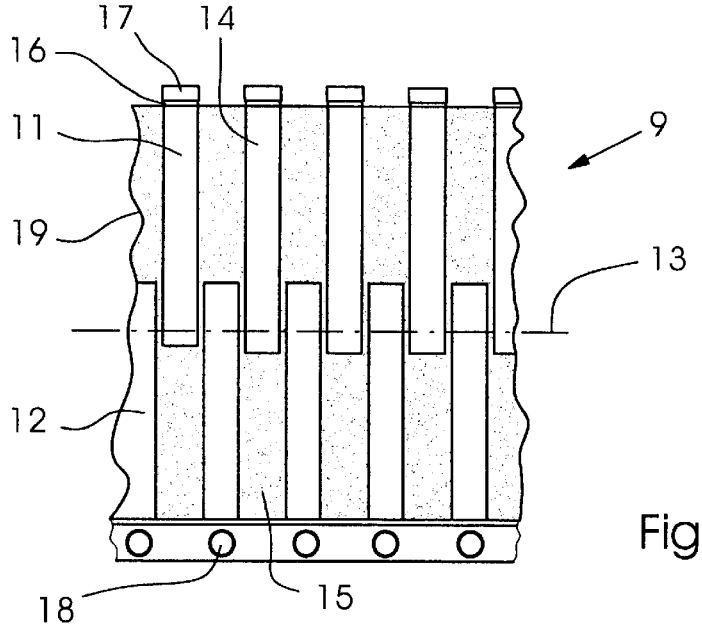
FIG. 2 is a fragmentary diagrammatic plan view of a sheet transport drum of the reversing or turning device constructed in accordance with the invention.

FIG. 2 is a fragmentary plan view of the sheet transport drum 9, this plan view showing that the sheet transport drum 9 comprises at least a first comb segment 11 and a second comb segment 12, which is mounted so that it can be rotated and/or pivoted about a pivot axis 13, which corresponds to the center axis of the sheet transport drum 9, relative to the first comb segment 11 for the purpose of adapting the sheet transport drum 9 to different format lengths of printing-material sheets which are to be transported. Each of the comb segments 11, 12 has prongs 14, which engage in interspaces 15 between the prongs of the respectively other comb segment.

An adjustment of the second comb segment 12 to the first comb segment 11, for the purpose of adapting it to a smaller sheet format, causes the prongs 14 to be pushed farther into the interspaces 15, the interspaces 15 being thereby narrowed, and an adjustment of the second comb segment 12 away from the first comb segment 11, for the purpose of adapting it to a larger sheet format, results in a widening of the interspaces 15.

The gripper system of the sheet transport drum 9 includes gripper supports 16, which are arranged on the front edge of the first comb segment 11, and grippers 17 (note FIG. 3), which are assigned to the gripper supports, in order to clamp the printing-material sheet in. Nozzle-like suckers 18 for applying suction to the printing-material sheet at the trailing edge thereof for holding the sheet are arranged in a row on the second comb segment 12 and are connected to a suction-air source.

For the purpose of adjusting the necessary distance, depending upon the format length, between the gripper system and the suckers 18, the latter, together with the second comb segment 12, are pivoted about the pivot axis 13 relative to the gripper system into a position wherein the suckers 18 are located in the vicinity of the trailing edge of the printing-material sheet held in the gripper system and beneath the printing-material sheet.

Figure 3:
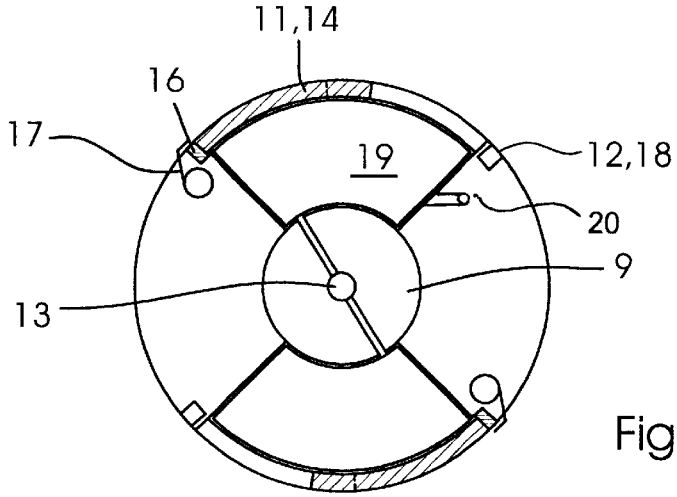
FIGS. 3 to 5 are diagrammatic end elevational views, partly in section, of FIG. 2, showing different exemplary embodiments of the sheet transport drum.

FIG. 3 is an end sectional view of a first exemplary embodiment of the sheet transport drum 9, according to which at least one covering 19 is disposed in the hollow interior of the sheet transport drum 9, beneath the comb segments 11 and 12. The covering 19 which, on the inside, abuts the comb segments 11 and 12, covers the interspaces 15 as a sealing element and prevents air flows out of the sheet transport drum 9 through the interspaces 15. The wall formed by the covering 19, which is constructed as a variable-volume expansion chamber or, more precisely, as a balloon, is formed of an expandable, flexible material, preferably an elastomer.

In contrast with the exemplary embodiment shown in FIG. 3, it is also possible for the variability of the volume to be provided by forming the covering 19 as an accordion-like bellows, the zigzag-shaped wall of which has inflection locations serving as bending joints.

Via a line 20, e.g., a tube, the illustrated covering 19 can be pumped up and/or inflated with air, and the air can later be evacuated again from the covering 19, e.g., by the air being forced or sucked out. Instead of air, it is also possible to use some other pressure fluid or gas for filling the covering 19.

The covering 19 functions as follows: as a result of each format conversion of the sheet transport drum 9 from a small format length to a large format length, i.e., due to each adjustment of the second comb segment 12 away from the first comb segment 11, a cavity which is bounded by the comb segments 11 and 12 and a core of the sheet transport drum 9, and which the covering 19 is able to fill, suitably widens.

Without an appropriate countermeasure, the widening of the cavity would cause the contact pressure of the covering 19 against the comb segments 11 and 12, which slackens as a result of the widening, to be lost somewhat, so that air-tight closure of the interspaces 15 by the covering 19 would no longer be ensured in an absolutely reliable manner. Moreover, due to this adjustment of the second comb segment 12, some of the interspaces 15 of the latter no longer overlap the covering 19.

The countermeasure that is taken thus involves further inflating the covering 19, preferably by compressed air, as a result of which the covering 19 expands, on the one hand, in the circumferential direction of the sheet transport drum 9, i.e., in the adjustment direction of the second comb segment 12, and, on the other hand, in the radial direction of the sheet transport drum 9. Due to the circumferential expansion of the covering 19, the interspaces 15 of the second comb segment 12 are completely closed again by the covering 19. The radial expansion of the covering 19 causes the covering 19 to fit more closely against the comb segment 12, so that the hermetic sealing of the interspaces 15 is ensured again. The air volume enclosed in the covering 19 is increased during or after each format adjustment from the small format length to the large format length.

Before or during each format adjustment in the opposite direction, from the large format length to the small format length, i.e., each adjustment of the second comb segment 12 to the first comb segment 11, the air volume enclosed in the covering 19 is reduced again by letting a given quantity of air out of the covering 19.

Figure 4:
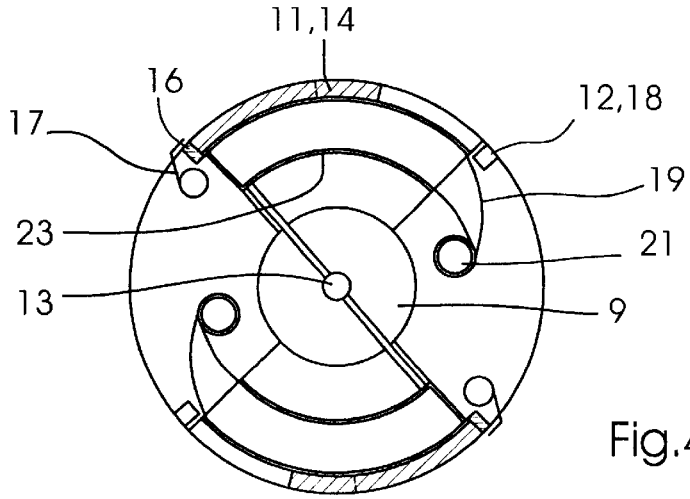

FIG. 4 illustrates a second exemplary embodiment, the parts 11 to 18 and 20 thereof corresponding to similarly identified parts of the first exemplary embodiment to which reference can be made for an explanation thereof, thereby avoiding unnecessary repetition herein.

Although the covering 19 of the second exemplary embodiment can indeed be expanded depending upon the format length, just like the covering of the first exemplary embodiment, by varying the internal pressure and/or the enclosed air volume thereof, it is constructed not as a balloon but as an inflatable flexible tube, a number of which are provided, i.e., one for each interspace 15.

The tubular covering 19 is guided by a prong-shaped guide 23 which extends beneath the corresponding interspace 15 equidistantly from the prongs 14 which bound the interspace 15. As to the inflation thereof, and the deflation thereof, depending upon the adjustment of the second comb segment 12, the tubular covering 19 is virtually the same, in functional terms, as the balloon-shaped covering of the first exemplary embodiment.

During or before inflation of the tubular covering 19, the latter can be unwound partially from a reel 21 fastened on the second comb segment 12, and as the air is let out therefrom, or just thereafter, the covering can be wound up partially onto the reel 21 again. A front end of the tubular covering 19 is fastened on the first comb segment 11, and a rear end of the covering 19 is fastened on the reel 21, with the result that, during each adjustment of the second comb segment 12 away from the first comb segment 11, the covering 19 is automatically unwound from the reel 21. The covering 19 and the reel 21 may form a type of roller blind, of which the spring is stressed or tightened by unwinding the covering 19, and subsequently drives the wind-up operation of the covering 19, wherein the spring is again relieved of stress.

Figure 5:
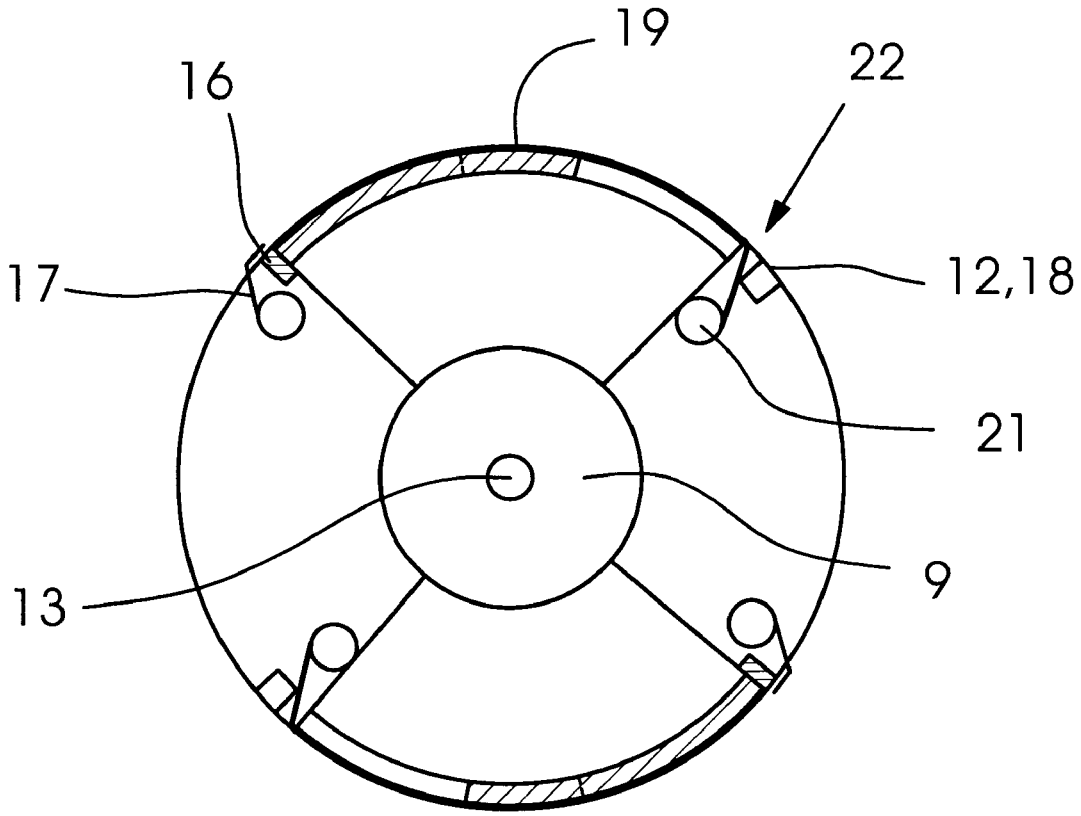

FIG. 5 illustrates a third exemplary embodiment, of which those parts which are also common to the other exemplary embodiments and which have already been described herein in conjunction with the latter, namely the parts 11 to 18, 20 and 21, will not be described again in order to avoid unnecessary repetition.

The covering 19 provided in the third exemplary embodiment is formed as a foil or sheeting covering all of the prongs 14 and the interspaces 15 of the comb segments 11 and 12, and made of polyester or a similar material, which provides the covering 19 with a given dimensional stability which is greater than the dimensional stability of the inflatable coverings shown in FIGS. 3 and 4.

The foil or sheeting-like covering 19 is tautened as cylinder dressing over the sheet transport drum 9, so that the covering 19 rests tautly on outer circumferential surfaces of the comb segments 11 and 12 and closes the interspaces 15 in an air-tight manner in order to prevent the follow-on flow or afterflow of the air through the interspaces 15, which adversely affects the transport of the sheets. A front end of the sheeting-like covering 19, which abuts the comb segments 11 and 12 on the outside, is fastened onto, for example, adhesively bonded to, the first comb segment 11 and a rear end is fastened onto the reel 21 integrated in the sheet transport drum 9, for example, is clamped therein. In the third exemplary embodiment, the reel 21, in the same manner as for the second exemplary embodiment, is rotatably fastened onto the second comb segment 12. The sheeting-like covering 19 is guided through a slit 22 extending parallel to the pivot axis 13, the slit 22 being formed in the second comb segment 12, located upline from the suckers 18, beneath the circumferential contour of the sheet transport drum 9 as far as the reel 21, which is seated in the interior of the drum and onto which the sheeting-like covering 19 is partially wound.

The winding-up and unwinding operations of the sheeting-like covering 19, these operations occurring automatically during the format conversions of the second comb segment 12, take place in a manner which is comparable to the herein aforedescribed operations of winding up and unwinding the tubular covering of the second exemplary embodiment.

I claim:

1. In a sheet-fed printing machine, a sheet transport drum, comprising a first comb segment and a second comb segment, said second comb segment being mounted so as to be rotatable relative to said first comb segment for providing an adjustment to a format length corresponding to that of a printing-material sheet, said comb segments being formed of prongs having interspaces therebetween, and at least one covering provided for covering said interspaces between said prongs.

2. The sheet transport drum according to claim 1, wherein said at least one covering engages, at the inside thereof, at least one of the comb segments.

3. The sheet transport drum according to claim 1, wherein said at least one covering is constructed so as to be actuatable pneumatically.

4. The sheet transport drum according to claim 3, wherein said at least one covering is inflatable.

5. The sheet transport drum according to claim 4, wherein said at least one covering is selected from the group consisting of a flexible tube, a bellows and a balloon.

6. The sheet transport drum according to claim 1, wherein said at least one covering engages at the outside thereof with at least one of said comb segments.

7. The sheet transport drum according to claim 1, wherein said at least one covering is a foil.

8. The sheet transport drum according to claim 1, wherein said at least one covering is partially wound up.

9. A sheet-fed printing machine having at least one sheet transport drum, the transport drum comprising a first comb segment and a second comb segment, said second comb segment being mounted so as to be rotatable relative to said first comb segment for providing an adjustment to a format length corresponding with that of a printing-material sheet, said comb segments being formed of prongs having interspaces therebetween, and at least one covering provided for covering said interspaces between said prongs.

10. The sheet-fed printing machine according to claim 9, including a reversing device of which the sheet transport drum is a constituent part.

11. The sheet-fed printing machine according to claim 10, wherein the sheet transport drum is constructed as a storage drum, and the reversing device includes a further sheet transport drum constructed as a reversing drum.

* * * * *